US006048008A

United States Patent [19]

Shaw

[11] Patent Number: 6,048,008

[45] Date of Patent: Apr. 11, 2000

[54] FECES REMOVAL DEVICE

[76] Inventor: Raymond Shaw, 21115 Tuck Rd., Farmington Hills, Mich. 48336

[21] Appl. No.: 09/164,065

[22] Filed: Sep. 30, 1998

[51] Int. Cl.[7] ..... A01K 29/00; E01H 1/12

[52] U.S. Cl. ..... 294/1.3

[58] Field of Search ..... 294/1.3, 1.4, 25, 294/55; 15/104.8, 257.1, 257.4, 257.6; 248/95, 97, 99, 101; 383/4, 6, 12, 33, 34; D30/161, 162

[56] References Cited

U.S. PATENT DOCUMENTS

| | | | |
|---|---|---|---|
| 3,739,418 | 6/1973 | Yonaites et al. | 294/1.3 |
| 3,799,598 | 3/1974 | Lavaggi . | |
| 3,806,984 | 4/1974 | Hilsabeck . | |
| 3,827,098 | 8/1974 | Sanderson . | |
| 3,868,135 | 2/1975 | Magliaro . | |
| 3,937,509 | 2/1976 | Hufnagel . | |
| 3,978,540 | 9/1976 | Peck et al. | 294/1.3 |
| 4,042,269 | 8/1977 | Skermetta . | |
| 4,138,153 | 2/1979 | Brown . | |
| 4,215,887 | 8/1980 | Boots | 294/1.4 |
| 4,273,370 | 6/1981 | Kjaer | 294/1.3 |
| 4,428,610 | 1/1984 | Guffey . | |
| 4,529,236 | 7/1985 | Vogt . | |
| 4,718,707 | 1/1988 | Greenhut . | |
| 4,830,419 | 5/1989 | Watanabe . | |
| 4,938,516 | 7/1990 | Temple . | |
| 4,948,266 | 8/1990 | Bencic | 294/1.3 X |
| 5,000,500 | 3/1991 | Almog . | |
| 5,037,149 | 8/1991 | Beck . | |
| 5,039,148 | 8/1991 | Brautovich . | |
| 5,131,704 | 7/1992 | Li . | |
| 5,186,384 | 2/1993 | Nelson . | |
| 5,193,870 | 3/1993 | Macinnis et al. . | |
| 5,222,777 | 6/1993 | Clonch . | |
| 5,358,295 | 10/1994 | Campbell . | |
| 5,385,376 | 1/1995 | Malaspina | 294/1.3 |
| 5,513,822 | 5/1996 | Gould . | |
| 5,564,763 | 10/1996 | Mercurio . | |
| 5,579,812 | 12/1996 | Bigwood . | |
| 5,702,138 | 12/1997 | Elkind . | |
| 5,718,469 | 2/1998 | Ockerman . | |

FOREIGN PATENT DOCUMENTS

| | | | |
|---|---|---|---|
| 37355 | 10/1981 | European Pat. Off. | 294/1.3 |
| 3326305 | 8/1984 | Germany | 294/1.3 |
| 4007051 | 9/1991 | Germany | 294/1.3 |
| 651873 | 10/1985 | Switzerland | 294/1.3 |

*Primary Examiner*—Johnny D. Cherry
*Attorney, Agent, or Firm*—Gifford, Krass, Groh, Sprinkle, Anderson & Citkowski, P.C.

[57] ABSTRACT

A device for removing and disposing of animal waste having a body consisting of a first planar shaped member and a second planar shaped member arranged in parallel extending and proximate fashion to the first planar member so that the planar members define opposingly facing surfaces. First and second elongate handles extend from the planar members and a flexible bag having an open end and a closed end is fitted to the device so that the planar members define a perimeter of the open end. The first and second handles are engaged to outwardly actuate the first and second planar shaped members relative to one another and so that the open end of the bag encompasses a solid waste object setting upon a ground location. The opposingly facing surfaces of the planar shaped members are capable of grasping and elevating the solid waste object and the device is adapted to being inverted to deposit the object with the bag interior.

7 Claims, 4 Drawing Sheets

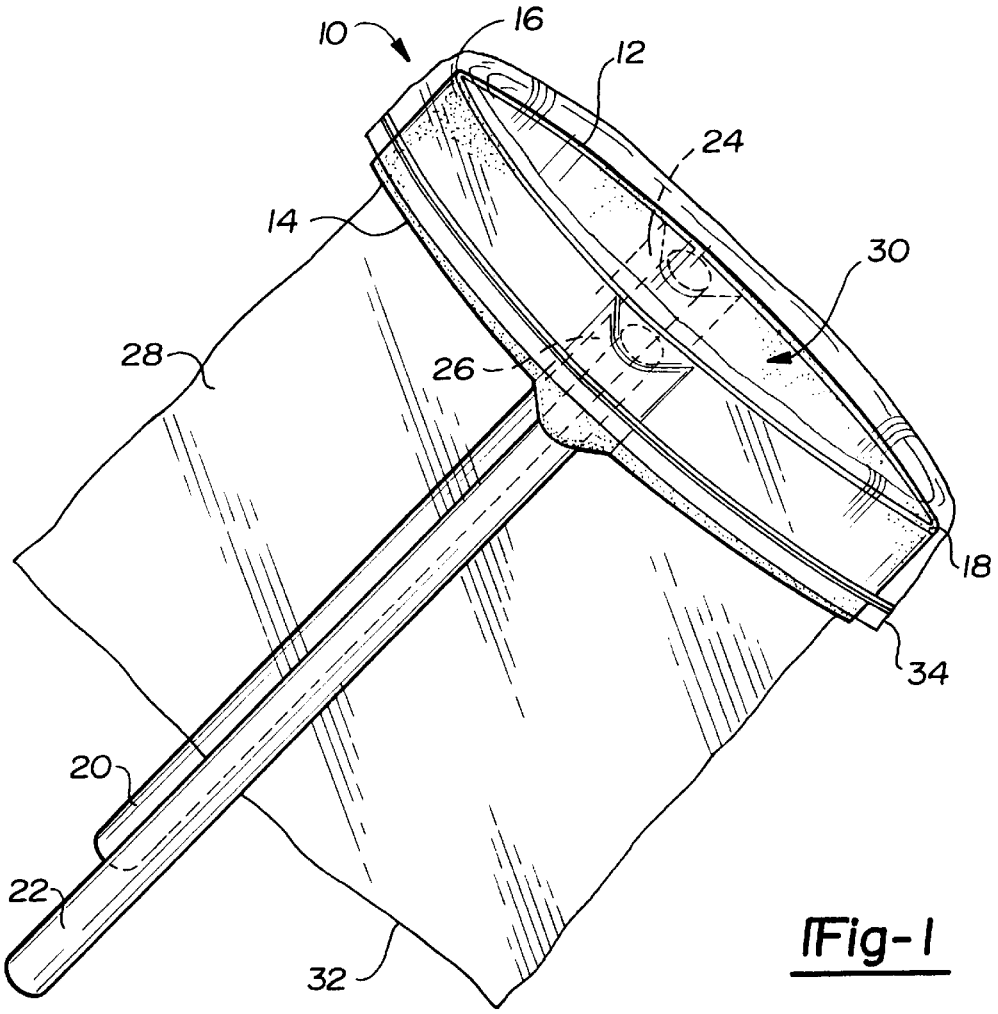
Fig-1
Fig-2
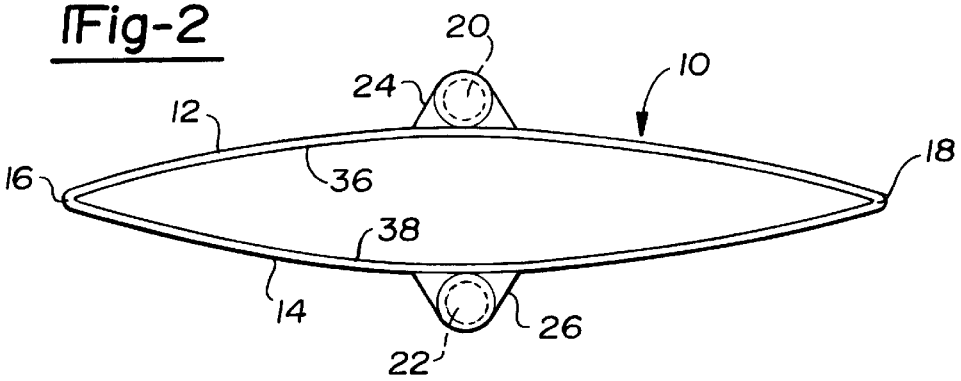

FECES REMOVAL DEVICE

BACKGROUND OF THE INVENTION

1. Field of the Invention

The present invention relates generally to animal waste collection devices and, more particularly, to a feces removal device ideally suited for use in city or suburban areas for efficiently removing and disposing of pet droppings and the like.

2. Description of the Prior Art

The patent art is well documented with examples of animal litter cleanup devices for removing and disposing of feces deposits. The objective in each instance is the ability to remove the animal droppings in as quickly and pleasantly a manner as possible.

U.S. Pat. No. 5,037,149, issued to Beck, discloses a dog litter cleanup bag having two stiffener ribs at or near its opening. Each of the stiffener ribs extends approximately one third the length of the opening circumference and are attached in end to end fashion. The ribs are flexible and so that a triangular shape is formed at the bag opening by spreading distal ends of the stiffeners apart until the unstiffened portions of the bag opening becomes taut. In this position, the bag is placed upon the ground and held with a finger while the litter is pushed into it.

U.S. Pat. No. 4,428,610, issued to Guffey, teaches a collapsible frame for collecting animal excrement and which includes a molded handle portion and a wire hoop portion. The wire hoop portion is rotated from a folded position in which it is snappingly retained in the same plane as the handle portion to a use position in which extends in a downward and forward manner relative to the handle portion. A plastic bag is installed on the deployed frame and the open edge is folded over the edges of the wire hoop and handle to permit the frame to remain clean, allowing it to be refolded and returned to the pocket or purse without cleaning. Additional examples of hand held apparatuses for removing animal waste are illustrated in U.S. Pat. No. 5,222,777, issued to Clonch, and U.S. Pat. No. 4,830,419, issued to Watanabe.

SUMMARY OF THE PRESENT INVENTION

The present invention discloses device for removing and efficiently disposing of animal waste having a body with a first planar shaped member and a second planar shaped member arrayed in substantially parallel extending and proximate manner to the first member so as to define opposingly facing surfaces therebetween. In one preferred embodiment, the planar members are constructed of elongate and rectangular shaped polymer elements which are interconnected by first and second hinged joints extending along opposite edges of the planar members. First and second elongate handles are secured to the first and second planar shaped members and a flexible bag having an open end and a closed end is provided and the open end fitted so that the planar shaped members substantially define a perimeter of the open end. The handles are adapted to be engaged and to outwardly actuate the first and second planar shaped members relative to one another so that the open end of the bag encompasses a solid waste object setting upon a ground location. The opposingly facing surfaces of the planar shaped members are capable of grasping and elevating the object and the device adapted to being inverted to deposit the object within the bag.

According to additional embodiments, the elongate handles include telescoping inner and outer portions and are rotatably secured to the planar shaped members to facilitate both scooping up of the waste object and placement within a pocket or other enclosure on the person utilizing the device. In another preferred embodiment, the first and second planar members are arrayed in parallel and proximate fashion but are not secured end to end. The elongate handles each include a central arm with a gripping portion placed thereon and pairs of downwardly extending legs which secure at opposite ends to each of the planar shaped members. The pairs of legs are pivotally secured together at the opposite ends to form a common pivot axis which is actuated by depressing the central arms together to outwardly actuate the planar shaped members.

According to a yet further embodiment, the first and second hinged joints each further include a planar and substantially "L" shaped element with first and second portions secured to the first and second planar shaped members. The hinged joints in this embodiment define an intermediate hinge between each of the first and second portions to cause the first and second planar members to be a spaced apart distance. The handles are integrally formed with the planar shaped members and the open end of the flexible bag includes first and second planar flaps secured to the opposingly facing surfaces of the planar members, a selected flap is capable of being detached from the associated surface of the planar member and resecured against the other flap to close off the bag interior.

BRIEF DESCRIPTION OF THE DRAWINGS

Reference will now be made to the attached drawings, when read in combination with the following specification, wherein like reference numerals refer to like parts throughout the several views, and in which:

FIG. 1 is a view in perspective of the removal device according to a first preferred embodiment of the present invention;

FIG. 2 is a top view of the removal device as shown in FIG. 1 and illustrating the resilient and outwardly bowing nature of the planar shaped members according to the present invention;

DETAILED DESCRIPTION OF THE PREFERRED EMBODIMENTS

Figure 3:
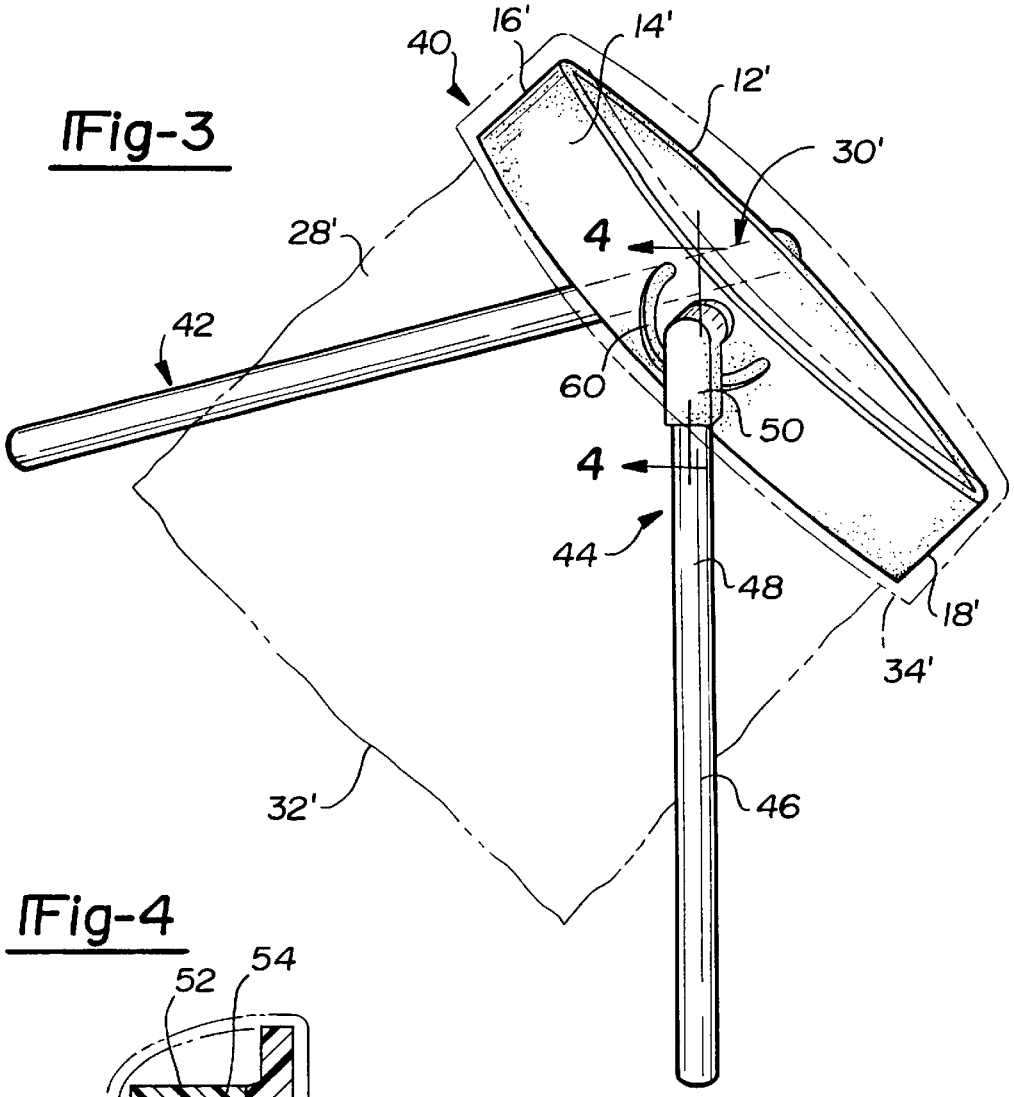
FIG. 3 is a view in perspective of the removal device according to a further preferred embodiment and illustrating the telescoping and pivoting nature of the elongate handles.

Referring now to FIGS. 1 and 2, a device for removing and efficiently disposing of solid animal waste and like is shown at 10 according to a first preferred embodiment of the present invention. The device includes a body including a first planar shaped member 12 and a second planar shaped member 14, each of the planar shaped members 12 and 14 being constructed preferably of a resilient and deformable material, such as a heavy duty corrugated cardboard and polymer based material, and shaped in an elongate and rectangular configuration. According to the first preferred embodiment 10, the planar shaped members 12 and 14 are secured together at opposite ends by hinges 16 and 18 which define a common boundary of the outermost edges of the planar shaped members and which permit the members to be outwardly and resiliently flexed in a bow-like manner.

A first elongate handle 20 is secured to and extends from the first planar shaped member 12 and a second elongate handle 22 likewise is secured to and extends from the second planar shaped member 14. The elongate handles 20 and 22 are preferably constructed of a durable and light-weight material such as a polymer and extend in a substantially perpendicular fashion from a longitudinal axis of the planar shaped members 12 and 14. The first elongate handle 20 is secured to a midpoint of the first planar shaped member 12 by mounting portion 24 and the second elongate handle 22 is secured to the midpoint of the second planar shaped member 14 by mounting portion 26.

A flexible bag 28 includes an open end 30 and a closed end 32 and is capable of being fitted to the planar shaped members 12 and 14 so that the members define a perimeter of the open end. In the preferred embodiment, a top edge 34 of the bag 28 is slid through opposingly and inwardly facing surfaces 36 and 38 of the planar shaped members 12 and 14 (see FIG. 2) and is then folded in a reverse fashion over the exterior facing surfaces to fixedly secure it to the body of the device 10. The handles 20 and 22 then function by permitting a user (not shown) to grip the free edges of the handles and outwardly actuate the handles in directions opposite from one another. The resultant outwardly bowing of the planar shaped members 12 and 14 in turn outwardly expands the open end 30 of the flexible bag 28 and permits a solid waste object such as pet feces (not illustrated) to be encompassed by the open end. The opposingly facing surfaces of the planar shaped members 12 and 14 are capable of grasping and elevating the object and the device 10 is adapted to then being inverted by the user (again not shown) so as to safely deposit the object within the interior confines of the bag 28.

Figure 4:
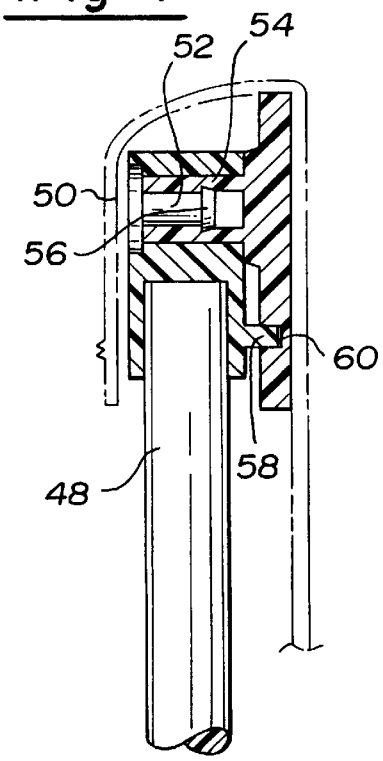
FIG. 4 is a cutaway view taken along line 4—4 of FIG. 3 and illustrating the pivotal mounting bolt and spaced apart pin for rotatably mounting the elongate handles to the first and second planar shaped members according to the present invention.
Figure 5:
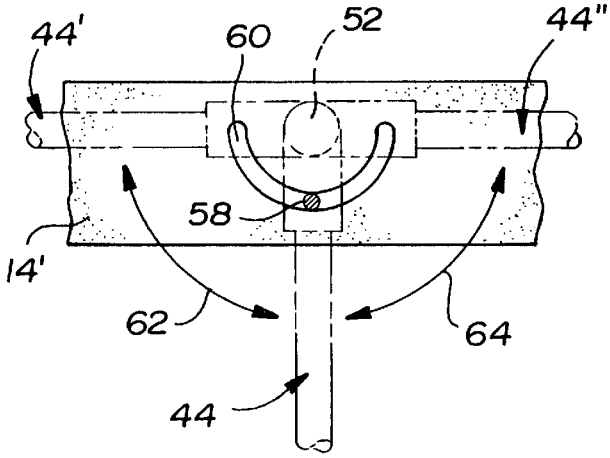
FIG. 5 is a sectional view further illustrating the pin and recessed channel arrangement which provides the 180 degree angular range of rotation of the elongate handles according to the present invention.

Referring now to FIGS. 3, 4 and 5, a waste removal/disposal device is illustrated according to a further preferred embodiment 40 of the present invention. The device 40 is largely similar to that illustrated at 10 in the first preferred embodiment of FIGS. 1 and 2 and includes such features as a first planar shaped member 12', a second planar shaped member 14', a first interconnecting hinge 16' and a second interconnecting hinge 18'. A flexible bag 28' is again provided and includes an open end 30', a closed end 32' and a top edge 34' which is folded over the planar shaped members to define a perimeter of the open end.

The embodiment 40 of FIGS. 3–5 differs from that of the first embodiment 10 primarily in the construction and functionality of first and second elongate handles 42 and 44 which secure to substantially midpoints of the first and second planar shaped members 12' and 14', respectively. As best illustrated by second elongate handle 44, it includes an outer telescoping portion 46 and an inner telescoping portion 48 and the handle 44 is secured to the planar shaped member 14' by connector 50. Any conventional means known in the art may be provided to fixedly adjust an overall distance of the telescoping portion of the handles such as to prevent an individual from stooping forward during the process of picking up the undesirable waste object.

Referring further to FIG. 4, the mechanism for rotatably securing the elongate handle 44 to the planar shaped member 14' includes a bolt 52 extending inwardly from the connector 50 which is received within a socket portion 54 forming a part of the planar member 14'. An enlarged annular bead 56 extending from the top of the bolt 52 is seated within a corresponding inner annular wall of the socket portion 54 and so that the handle 44 is capable of rotating about a desired annular range relative to the planar shaped member 14'.

According to the preferred embodiment, the handles 42 and 44 are capable of rotating an angular range of 180 degrees and this is further provided by a pin 58 extending from the connector 50 in parallel and spaced apart fashion relative to the bolt 52 and which is seated within a recessed and angularly extending channel 60 formed within the surface of the planar shaped member 14'. Referring further to FIG. 5, the range of angular motion of the handle 44 is best shown and includes a first phantom designation 44' along directional line 62 and a second phantom designation 44" along directional line 64. It is desirable to construct the elongate handles so that they can pivot to a direction substantially parallel and in line with the longitudinal axis of the elongate and rectangular shaped members 12' and 14' since this facilitates the user being able to store the waste object held in the bag, such as by placing it in the user' pocket or in another confined area where the otherwise inability to fold or pivot the elongate arms would provide difficulty. In use, the flexible baggie 28' may be removed from the device 40 with the waste object held within, sealed and disposed of in the desired fashion.

Figure 6:
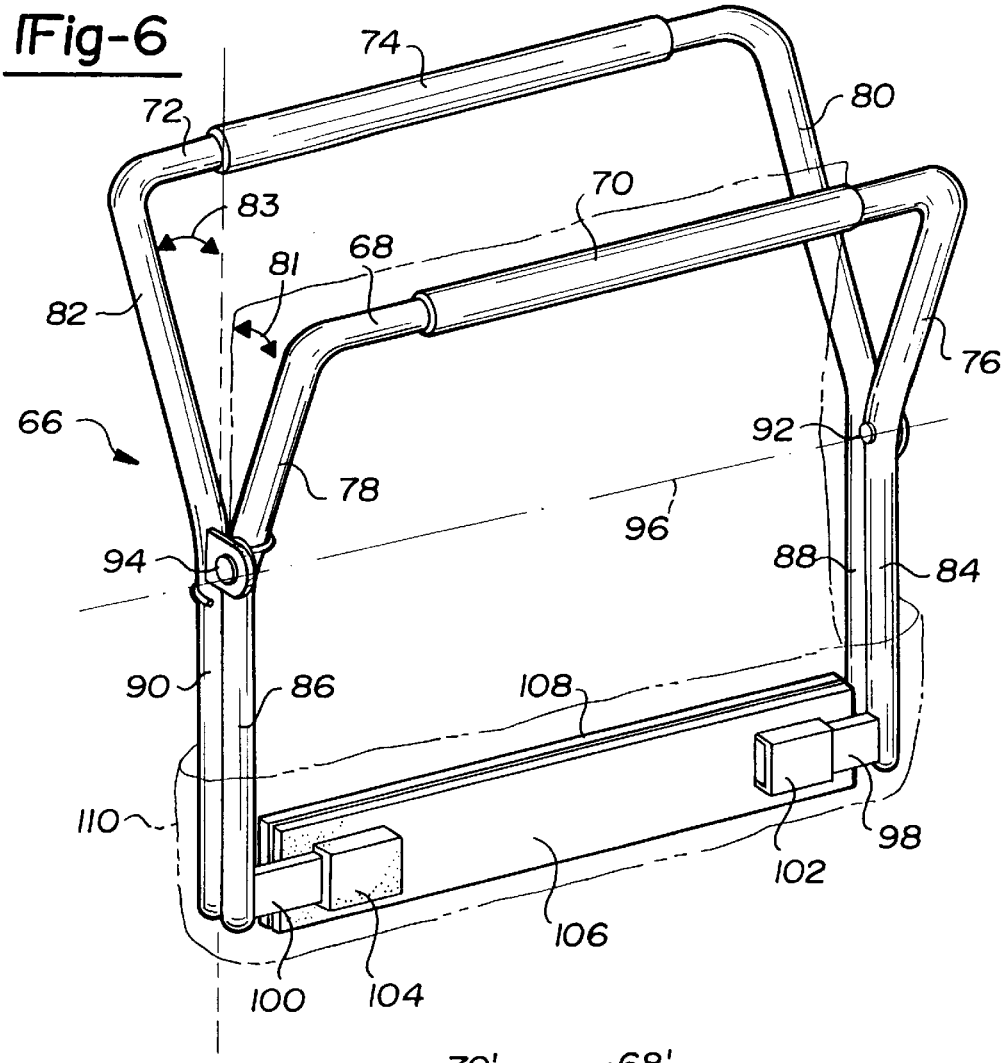
FIG. 6 is a view of the removal device according to a still further preferred embodiment of the present invention.
Figure 7:
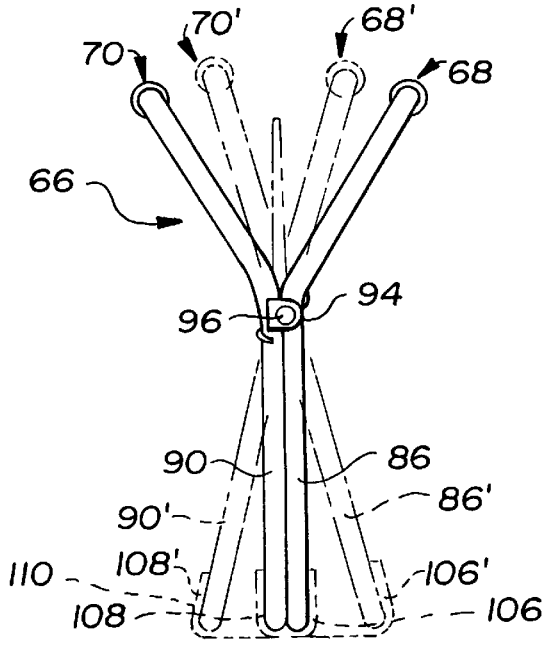
FIG. 7 is an end view of the removal device shown in FIG. 6 and further illustrating the pivotal nature of the pivotally interconnected pairs of legs for outwardly actuating the first and second planar shaped members.

Referring now to FIGS. 6 and 7, a device is shown at 66 according to a further preferred embodiment of the present invention for removing and disposing of solid waste objects and includes handles constructed in the form of a first central arm 68 with a first elongate gripping portion 70 placed thereon and a second central arm 72 with a second elongate gripping portion 74 likewise placed thereon. A first leg 76 extends downwardly from a first end of the central arm 68 and a second leg 78 extends downwardly from a second end of the central arm 68. Likewise, a first leg 80 extends downwardly from a first end of the central arm 72 and a second leg 82 extends downwardly from a second end of the central arm 72. The first and second pairs of legs 76 and 80 and 78 and 82 extend in a substantially downwardly and inwardly angled fashion, as referenced by reference arrows 81 and 83, and define a desired spacing of the first and second central arms 68 and 72.

Each of the first and second pairs of legs further includes interconnecting downward and level extending lower portions. Specifically, the first leg 76 continues as leg portion 84, second leg 78 as leg portion 86, first leg 80 as leg portion 88, and second leg 82 as leg portion 90. The first leg 76 of the first handle is pivotally secured to the first leg 80 of the second handle and, likewise, the second leg 78 is pivotally secured to second leg 82, by a first pivot connection 92 and a second pivot connection 94 which extend along a common axis 96.

Each of the lower leg portions includes inwardly extending foot portions which are received within through apertures formed in projecting members formed in turn upon exterior facing surfaces of the planar shaped members. Specifically, as is best shown from the view of FIG. 6, a first inwardly extending foot portion 98 extends from the lower leg portion 84 and, likewise, a second inwardly extending foot portion 100 extends from the lower leg portion 86. Additional foot portions of the lower leg portions 88 and 90 for the second handle are hidden from view. The foot portions 98 and 100 are received within apertures of projecting members 102 and 104 and so that, upon actuating the handles 68 and 70 together to positions 68' and 70' as illustrated in FIG. 7, planar shaped members 106 and 108 are likewise outwardly actuated to spaced apart locations 106' and 108' and a desired solid waste object is capable of being deposited within a flexible bag 110 secured to the device 66.

Figure 8:
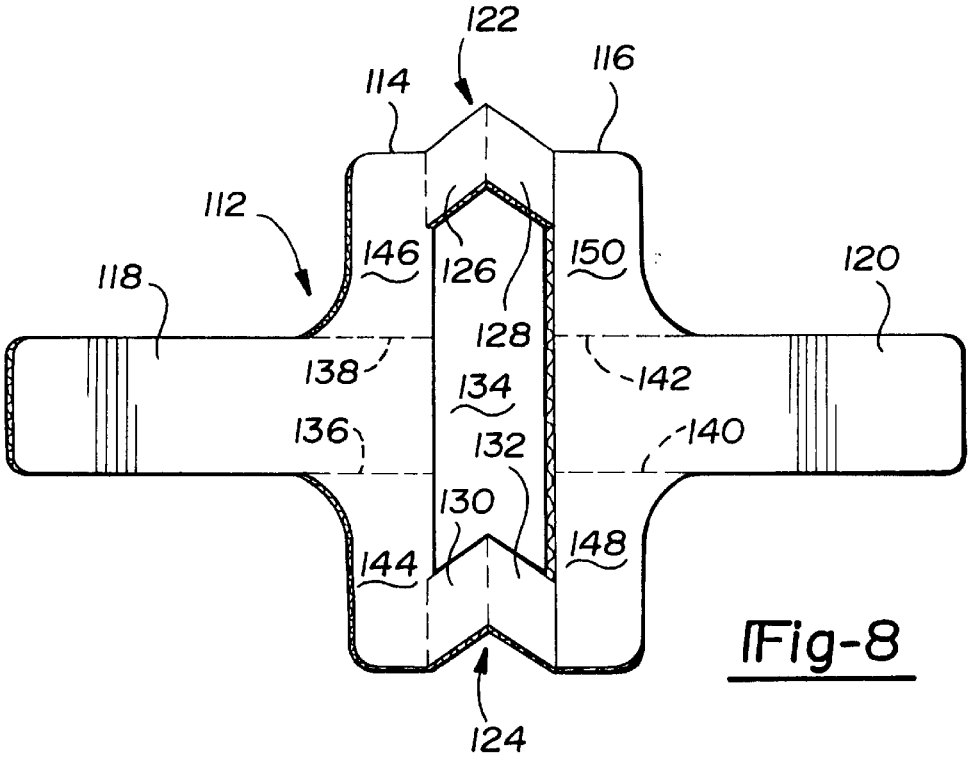
FIG. 8 is a view in plan of the removal device according to a still further preferred embodiment of the present invention.
Figure 9:
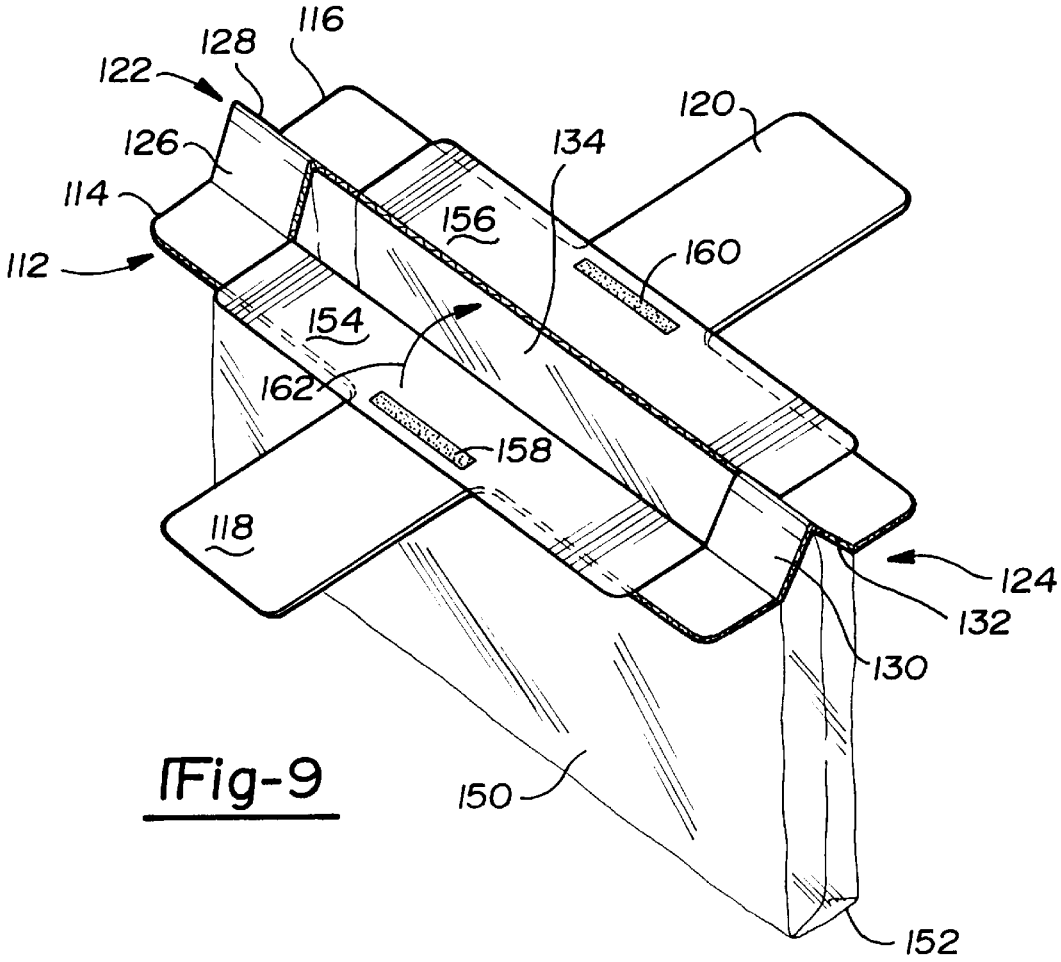
FIG. 9 is a perspective view of the removal device according to FIG. 8 with the flexible bag attached and further showing the pivotal nature of the device for removing and disposing of the solid waste object.

Referring finally to FIGS. 8 and 9, a further illustrated embodiment is shown at 112 for removing and disposing of solid waste objects and includes a biodegradable laminate board material, such as a type of corrugated paper, which is formed within an overall blank shape and consists of a body with a first overall planar shaped member 114 and a second interconnected planar shaped member 116. A first elongate and substantially flattened handle 118 is integrally formed with and extends from the first planar shaped member 114 and a second such handle 120 is likewise formed with and extends from the second planar shaped member 116.

The hinged connection between the first and second planar shaped members 114 and 116 is provided by a first "L" shaped hinged joint 122 and a second "L" shaped hinged joint 124, the hinged joints 122 and 124 being arranged at opposite ends of the opposing surfaces of the planar shaped members. The first hinged joint 122 includes a first leg 126 extending from member 114 and a second leg 128 extending from member 116 which are hingedly connected together. Likewise, the second hinged joint 124 includes a first leg 130 extending from member 114 and a second leg 132 extending from member 116 and which are also hingedly connected together. The "L" shaped hinged joints 122 and 124 space apart the planar shaped members 114 and 116 to define an opening 134 of suitable dimension for permitting a flexible bag to be secured thereto and for disposing of undesirable solid waste objects as will be subsequently described. Additional fold lines 136, 138, 140 and 142 are further provided and extend in spaced apart and parallel fashion along a width of each of the first and second planar shaped members 114 and 116 corresponding in placement and direction with the elongate handles 118 and 120. The purpose of the fold lines is to permit outer perimeter portions (as defined at 144, 146, 148 and 150 in the view of FIG. 8) to be folded inwardly during disposal of the device 112 with the object held therein.

Referring further to the operative view of FIG. 9, a bag 150 is again shown with a lower closed end 152 and an upper open end corresponding with the opening 134. The open end of the bag 150 is further defined by a first flap 154 secured to an inwardly and opposingly facing surface of the first planar shaped member 114 and a second flap 156 secured to an inwardly and opposingly facing surface of the second planar shaped member 116. Either or both of the flaps may include additional adhesive portions placed thereon (such as at 158 and 160) and the purpose for which is to permit the flap (see flap 154 of FIG. 9) to be disengaged from the associated planar member and folded along directional line 162 to secure against the other flap 156 and to thereby close off the interior of the bag 150. The hinged portions 122 and 124 further permit the planar shaped members to pivot to encompass, grasp and deposit the solid waste object in the fashion previously described.

Having described my invention, additional embodiments will become apparent to those skilled in the art to which it pertains without deviating from the scope of the appended claims:

I claim:

1. A device for removing and efficiently disposing of animal waste and the like, said device comprising:

a body including a first planar shaped member and a second planar shaped member arrayed in substantially parallel extending and proximate manner to said first member so that said planar shaped members have opposingly facing edges;

a first elongate handle integrally formed with and extending from said first planar shaped member and a second elongate handle integrally formed with and extending from said second planar shaped member;

a flexible bag having an open end and a closed end, said bag capable of being fitted to said body so that said first and second planar shaped members substantially define a perimeter of said open end;

a first hinged joint and a second hinged joint interconnecting said first planar shaped member to said second planar shaped member, said first and second hinged joints extending at opposing ends of said first and second planar shaped members and each further including first and second planar shaped legs hingedly connected together, an intermediate hinge defining a boundary between each of said first and second legs and causing said first planar shaped member to be spaced a distance from said second planar shaped member; and said first and second handles being engaged to outwardly actuate said first and second planar shaped members relative to one another so that said open end of said bag encompasses a solid waste object setting upon a ground location, said opposingly facing surfaces of said planar shaped member capable of grasping and elevating the object and said device being inverted to deposit the object within said bag.

2. The device for removing animal waste according to claim 1, said first and second elongate handles each securing to a substantially midpoint location of said first and second planar shaped members.

3. The device for removing animal waste according to claim 1, said open end of said flexible bag including a first flap secured to said opposingly facing edge of said first planar shaped member and a second flap secured to said opposingly facing edge of said second planar shaped member.

4. The device for removing animal waste according to claim 3, a selected one of said first and second flaps further comprising an adhesive portion placed upon an inwardly facing surface and said flap being detachable from said associated planar shaped member and resecurable over said other flap to enclose an interior of said bag.

5. The device for removing animal waste according to claim 3, said body and said integrally formed handles being constructed of a biodegradable laminate board material.

6. A device for removing and efficiently disposing of animal waste and the like, said device comprising:

a body including a first planar shaped member and a second planar shaped member arrayed in substantially parallel extending and proximate manner to said first member so that said planar shaped members have opposingly facing edges;

a first elongate handle secured to and extending from said first planar shaped member and a second elongate handle secured to and extending from said second planar shaped member, said first and second elongate handles being integrally formed with said first and second planar shaped members, respectively;

a flexible bag having an open end and a closed end, said open end of said flexible bag including a first flap secured to said opposingly facing edge of said first planar shaped member and a second flap secured to said opposingly facing edge of said second planar shaped member, said bag capable of being fitted to said body so that said first and second planar shaped members substantially define a perimeter of said open end, a selected one of said first and second flaps further including an adhesive portion placed upon an inwardly facing surface and said flap being detachable from said associated planar shaped member and resecurable over said other flap to enclose an interior of said bag;

a first hinged joint and a second hinged joint interconnecting said first planar shaped member to said second planar shaped member, said first and second hinged joints extending at opposing ends of said first and second planar shaped members, said first and second hinged joints each further including first and second planar shaped legs hingedly connected together, said first and second hinged joints each further including an intermediate hinge defining a boundary between each of said first and second legs and causing said first planar shaped member to be spaced a distance from said second planar shaped member; and first and second fold lines extending in spaced apart and parallel fashion along a width of each of said first and second planar shaped members, said fold lines corresponding in placement and direction with said elongate handles extending from said planar shaped members;

said first and second handles being engaged to outwardly actuate said first and second planar shaped members relative to one another so that said open end of said bag encompasses a solid waste object setting upon a ground location, said opposingly facing surfaces of said planar shaped member capable of grasping and elevating the object and said device being inverted to deposit the object within said bag.

7. The device for removing animal waste according to claim 6, said fold lines defining outer perimeter portions of said first and second planar shaped members, said outer perimeter portions capable of being folded inwardly about said fold lines.

* * * * *